US008516865B2

(12) United States Patent
Ferreira Sánchez

(10) Patent No.: US 8,516,865 B2
(45) Date of Patent: Aug. 27, 2013

(54) CLUTCH MECHANISM FOR ELECTROMECHANICAL LOCK CYLINDERS

(75) Inventor: Carlos Ferreira Sánchez, Oiartzun (ES)

(73) Assignee: Salto Systems, S.L., Oiartzun (Guipuzcoa) (ES)

( * ) Notice: Subject to any disclaimer, the term of this patent is extended or adjusted under 35 U.S.C. 154(b) by 0 days.

(21) Appl. No.: 13/442,939

(22) Filed: Apr. 10, 2012

(65) Prior Publication Data

US 2012/0260704 A1 Oct. 18, 2012

(30) Foreign Application Priority Data

Apr. 14, 2011 (ES) ..... 201130588

(51) Int. Cl.
*E05B 47/06* (2006.01)

(52) U.S. Cl.
USPC ..... 70/472; 70/223; 70/278.7

(58) Field of Classification Search
USPC ..... 70/149, 188, 189, 222, 223, 278.1, 70/278.7, 283, 283.1, 472
See application file for complete search history.

(56) References Cited

U.S. PATENT DOCUMENTS

| | | | | |
|---|---|---|---|---|
| 5,105,673 | A | 4/1992 | Shibata | |
| 6,334,348 | B1 * | 1/2002 | Ming-Chih | 70/472 |
| 6,845,642 | B2 * | 1/2005 | Imedio Ocana | 70/277 |
| 7,231,791 | B2 * | 6/2007 | Sakai | 70/277 |
| 7,698,919 | B2 * | 4/2010 | Kim | 70/280 |
| 7,827,837 | B2 * | 11/2010 | Huang et al. | 70/277 |
| 7,963,134 | B2 * | 6/2011 | Rafferty et al. | 70/218 |
| 7,966,854 | B2 * | 6/2011 | Imedio Ocana | 70/472 |
| 8,011,217 | B2 * | 9/2011 | Marschalek et al. | 70/473 |
| 2010/0012454 | A1 * | 1/2010 | Imedio Ocana | 192/84.6 |

FOREIGN PATENT DOCUMENTS

| | | |
|---|---|---|
| ES | 2 331 865 | 1/2010 |
| WO | 02/059443 | 8/2002 |

OTHER PUBLICATIONS

International Search Report issued Aug. 30, 2012 in International (PCT) Application No. PCT/ES2012/070235.

* cited by examiner

*Primary Examiner* — Christopher Boswell
(74) *Attorney, Agent, or Firm* — Wenderoth, Lind & Ponack, L.L.P.

(57) ABSTRACT

An improved clutch mechanism for electromechanical lock cylinders is disclosed. The aim of the invention is to improve the performance of the clutch mechanism and to increase the battery life of the motor which is included in the electromechanical lock cylinder. The improved clutch mechanism comprises an electromagnetic motor (2) with a threaded spindle (3) on its shaft; and a movable cart (4), which comprises a resilient device determined by two front springs (26) joined together at one of their ends by a common transverse portion (26') engaged in a valley of the spindle (3) thread, which moves the movable cart (4) by means of the common transverse portion (26') between a disengaged position and an engaged position, such that in both positions the common transverse portion (26') carries out a continuous thrust on the spindle (3).

14 Claims, 10 Drawing Sheets

CLUTCH MECHANISM FOR ELECTROMECHANICAL LOCK CYLINDERS

OBJECT OF THE INVENTION

The present invention, as stated in the title of this specification, refers to an improvement of the Spanish invention patent ES2331865B1 which discloses a Clutch Mechanism Applicable to Electromechanical Lock Cylinders.

The aim of the invention is to improve the performance of the clutch mechanism and to increase the battery life of the motor which is included in the electromechanical lock cylinder, thereby achieving a smoother and effective operation of the clutch mechanism and, therefore, of the lock assembly.

More specifically, the improvement of the invention is focused on a novel movable cart axially displaceable to engage and disengage a clutch disc associated with a cam responsible for conducting the driving of the latch and/or bolt of the lock, and a novel control of the electromagnetic motor.

BACKGROUND OF THE INVENTION

Currently, there are known electromechanical locks, operation of which is based on a lock code, using an electronic card or key, thereby activating a mechanical system that performs the opening or closing of the door wherein the lock is installed.

This installation or system is mounted within the knob or knobs of the door cylinder involved in the lock assembly, resulting in a significant limitation of space.

Moreover, current clutch systems that are mounted in conventional locks require, for their operation, electric motors of large size in order to actuate the clutch mechanism itself. Logically, this implies a waste of space, both that occupied by the motor and that occupied by the clutch system. Furthermore, the known and forced arrangement of limit switch detectors results in that the space required have to be even greater.

In short, the clutch mechanisms applicable to existing electromechanical locks imply a remarkable space occupation, which obviously affects an increase of the volume corresponding to the assembly making up the clutch mechanism associated with the electric drive motor.

On the other hand, there is known the patent ES2331865B1 (of the same applicant as the present invention) consisting of a clutch mechanism applicable to electromechanical lock cylinders comprising a cylinder mounted on the lock inside and axially including a rotor carrying the corresponding clutch means on the basis of which is susceptible to be interlock with a clutch disc on which the cam, rotation of which causes the actuation of the lock latch and/or bolt, is fixed.

It is characterized in that the clutch means are formed from a cart axially movable by actuating a spindle coupled at the output of the electromagnetic motor; with the particularity that on one of the valleys of the spindle one of the branches of an "U"-shaped resilient member is positioned, of unequal side branches and located in a housing provided on the inner face of the base body that forms part of the cart itself, in combination with a lid attached to said base through suitable screws; with two springs being provided in the base and in lid of the axially arranged cart, which by one end are support on the inner face of the lid itself, while by the other end are partially housed in end housings belonging to the clutch pins susceptible to occupy an inoperative and withdrawal position to the rotor lid, or an operating and emerging position, passing through holes provided in the corresponding clutch disc to which the cam is fixed for actuating the lock latch and/or bolt; with the further particularity that the cart is prevented from rotating by means of a pair of rods emerging from the inner face of the rotor lid, said rods further constituting a guiding means with minimum friction in the axial displacements of the cart.

A first problem with the patent ES2331865B1 is that if a user is applying a torque to the knob against the lock mechanisms, the clutch pins are disposed between the rotor lid and the clutch disc, failing to be removed. The cart cannot be removed either, whereby the spindle and the motor are blocked. This blockage is detected by the motor circuit; the detection is done by increasing the power consumption, resulting in the disconnection of the motor itself during a split second operation, for then trying again to repeatedly disengage the cylinder until there is no cause of blockade.

The problem is that if the user is maintaining the torque for a long time without being able to release the clutch pins, the consumption of the motor increases, due to repeated connections and disconnections of the motor and, therefore, the life battery of the motor shortens.

Likewise, a second problem that the cart has is that the resilient member has a poor performance. This is because, on the one hand, the greater branch of the "U"-shaped resilient member is subjected to a double recess at its ends, meaning that the deformation experienced by that greater branch is very small, which in addition to reduce the performance involves a correct design of the position of the resilient member in the base body of the cart in order to ensure the contact between said branch and the spindle in its extreme positions. Furthermore, the power load of a resilient member is proportional to the length of the wire, being in this case very limited because the length of wire would only be the grater branch of the resilient member.

DESCRIPTION OF THE INVENTION

In order to achieve the objectives and avoid the drawbacks mentioned in the preceding paragraphs, the present invention proposes improvements to the invention patent ES2331865B1, which discloses a Clutch Mechanism Applicable to Electromechanical Lock Cylinders. Therefore, ES2331865B1 is the closest prior art, on which the preamble of appended independent claim is based.

Improvements in the new clutch mechanism improve its performance and also increase the battery life of the motor.

The clutch mechanism applicable to electromechanical lock cylinders are constituted from a rotor that is a cylindrical body and inside which is mounted an actuating electromagnetic motor. The electromagnetic motor has an output shaft on which a spindle is axially mounted. The spindle is provided so as its rotation produces a linear displacement of a movable cart also located inside the rotor, this being closed by its free end by a front lid, so that the referred assembly, i.e., the rotor and the other elements corresponding to the clutch mechanism, are within the outer lock cylinder.

In turn, the electromagnetic motor comprises a control circuit.

Thus, the clutch mechanism applicable to electromechanical lock cylinders comprises the movable cart axially displaceable within the rotor, this being housed inside the outer lock cylinder, the electromagnetic motor being also located inside the rotor, output shaft of which is connected with the spindle located in correspondence with a central hole of the movable cart. The spindle rotation generates the axial displacement of the movable cart. The movable cart is guided in guides that are part of the front lid fixed to the rotor.

Additionally, the movable cart comprises a lid and a base housing clutch pins associated to respective rear springs located in axial housings provided on end sections of the clutch pins. These latter are located and guided in an axial holes of the base of the movable cart, the clutch pins being also guided in holes of the front lid. Following the front lid, there is provided a clutch disc provided with axial holes, which are faced in a specific angular position of the clutch disc with holes of the front lid. To the clutch disc a cam, responsible of performing the actuation of the latch and/or lock by rotating the same when the clutch pins are fitted into the axial holes of the clutch disc, is fixed.

Therefore, the front lid of the rotor has the abovementioned pair of holes that constitute a guide for the clutch pins in the displacement thereof with the movable cart assembly. So that, when the clutch pins emerge through the holes of the front lid, the clutch pins can engage the clutch disc and, thus, with the cam responsible for performing the actuation of the lock latch and/or bolt. The cam is fixed, by screws, to a clutch disc having axial bores into which the clutch pins are fitted.

Innovatively, the improved clutch mechanism of the present invention replaces the "U"-shaped resilient member included in the movable cart according to the prior art by a resilient device determined by two front springs joined together at one of their ends by a common transverse portion. Additionally, the movable cart is innovatively modified to contain the new resilient device.

Using the new movable cart in general, and in the resilient device comprised in the movable cart in particular, are resolved the two problems associated with the patented of the state of the art and are obtained at least two technical effects. The first technical effect, associated with the first problem, is to avoid the increase in the current consumption in the electromagnetic motor, as well as to avoid the constant connections/disconnections of the motor. The second technical effect associated with the second problem, is to help the electromagnetic motor to start its movement both at the beginning of stroke (engaged position) and at the end of stroke (disengaged position). The second technical effect is achieved by the continuous thrust of the resilient device on the thread of the spindle. The first technical effect is achieved by partial compression of the front springs and an improved motor control circuit.

Therefore, the improved mechanism of the present invention comprises: i) an electromagnetic motor which comprises an output shaft connected to a threaded spindle; and, ii) a movable cart axially displaceable by the spindle. Wherein the movable cart, in turn, comprises clutch pins. As novel, the movable cart of the improved mechanism of the present invention further comprises in its interior a resilient device determined by two front springs joined together at one of their ends by a common transverse portion engaged in a valley of the spindle thread, which moves the movable cart by means of the common transverse portion between a disengaged position and an engaged position, such that in the disengaged position, the front springs are compressed and in the engaged position the common transverse portion is deformed (state of over-elongation), such that in both positions the common transverse portion carries out a continuous thrust on the spindle.

The improved clutch mechanism further comprises an improved control circuit for the electromagnetic motor, which in case of blocking the movable cart in the engaged position by the action of a user, the control circuit detects the latching clutch pins and continuously compresses the front springs by the action of the spindle on the common transverse portion up to a such a position that when the blocking action by the user is finished, the clutch pins are released and the movable cart is moved up to the disengaged position. The displacement of the movable cart up to the disengaged position is carried out by the decompression of the front springs. Additionally, the control circuit sends a signal to the electromagnetic motor for rotating the spindle until the common transverse portion is located at the end of disengagement stroke, once completing the blockage of the movable cart and this is in the disengaged position.

The control circuit detects the latching of the clutch pins through the detection of an excess of the energy consumption in the compression of the front springs performed by the action of the spindle on the common transverse portion when attempting to bring the movable cart from the engaged position to disengaged position.

Front springs are coupled in tubular portions departing from the bottom of side recesses of a base comprised in the movable cart, the side recesses being at diametrically opposite points on the inner face of the base of the movable cart.

The clutch mechanism of the present invention further comprises guides that guide the cart movable in its axial movement, the guides forming part of the front lid. The guides are coupled and guided in a set of through bores established in the tubular portions.

The clutch mechanism of the present invention further comprises axial holes in the base wherein the clutch pins are housed, which are arranged in a diametrical direction and perpendicular to the diametrical direction in which the tubular portions are located.

Hereinafter, in order to provide a better understanding of this specification and being an integral part thereof, some figures in which the object of the invention has been represented are attached in an illustrative and not limitative manner.

The lock basically comprises an outer cylinder, within which is in turn housed a rotor and inside of this a motor output shaft of which is connected to a spindle, rotary movement of which drags an axially displaceable cart, whereby the engaged and disengaged positions of the clutch mechanism are reached.

Figure 1:
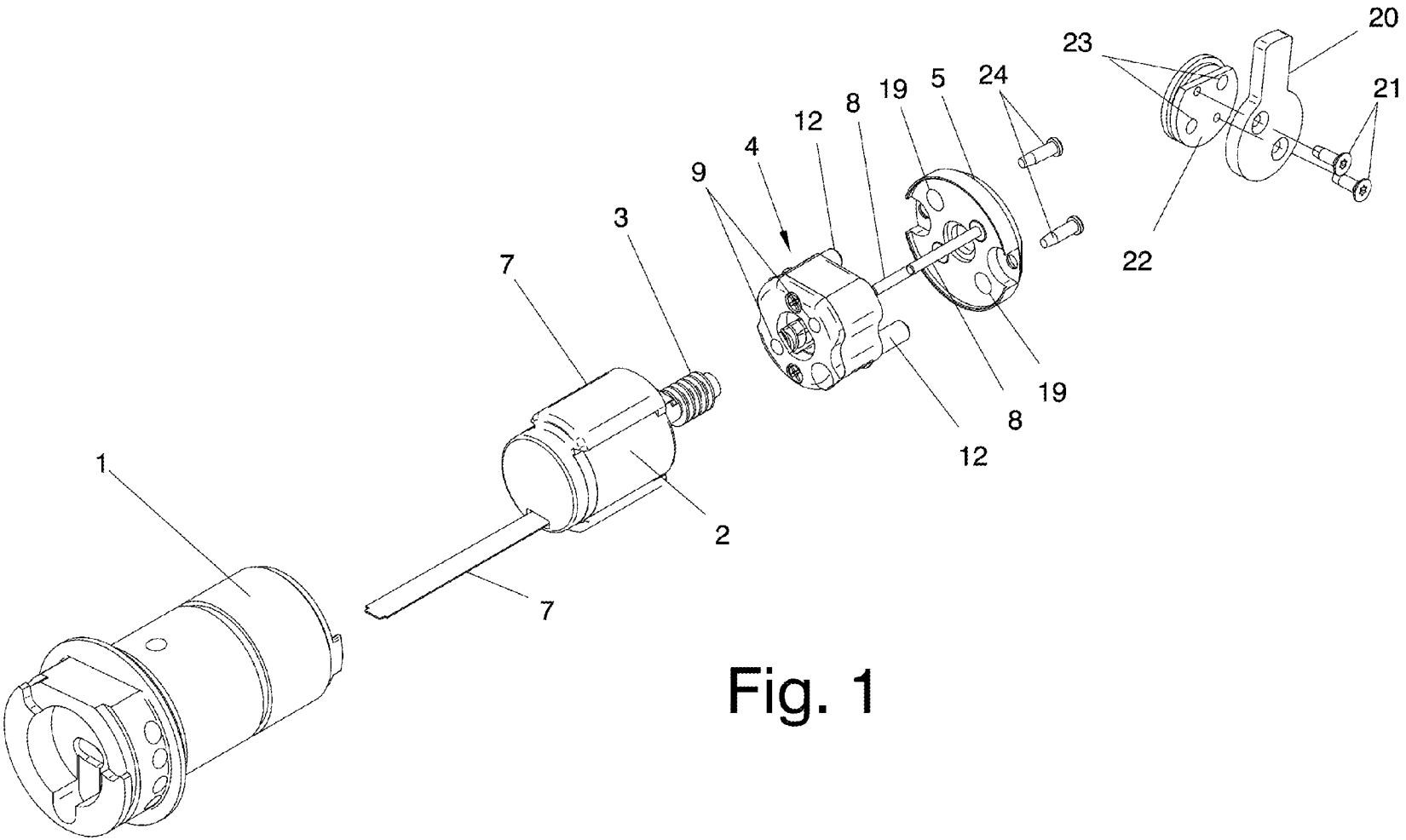
FIG. 1.—Shows an exploded perspective view of an electromechanical lock including therein the improved clutch mechanism for electromechanical cylinders of the present invention.
Figure 2:
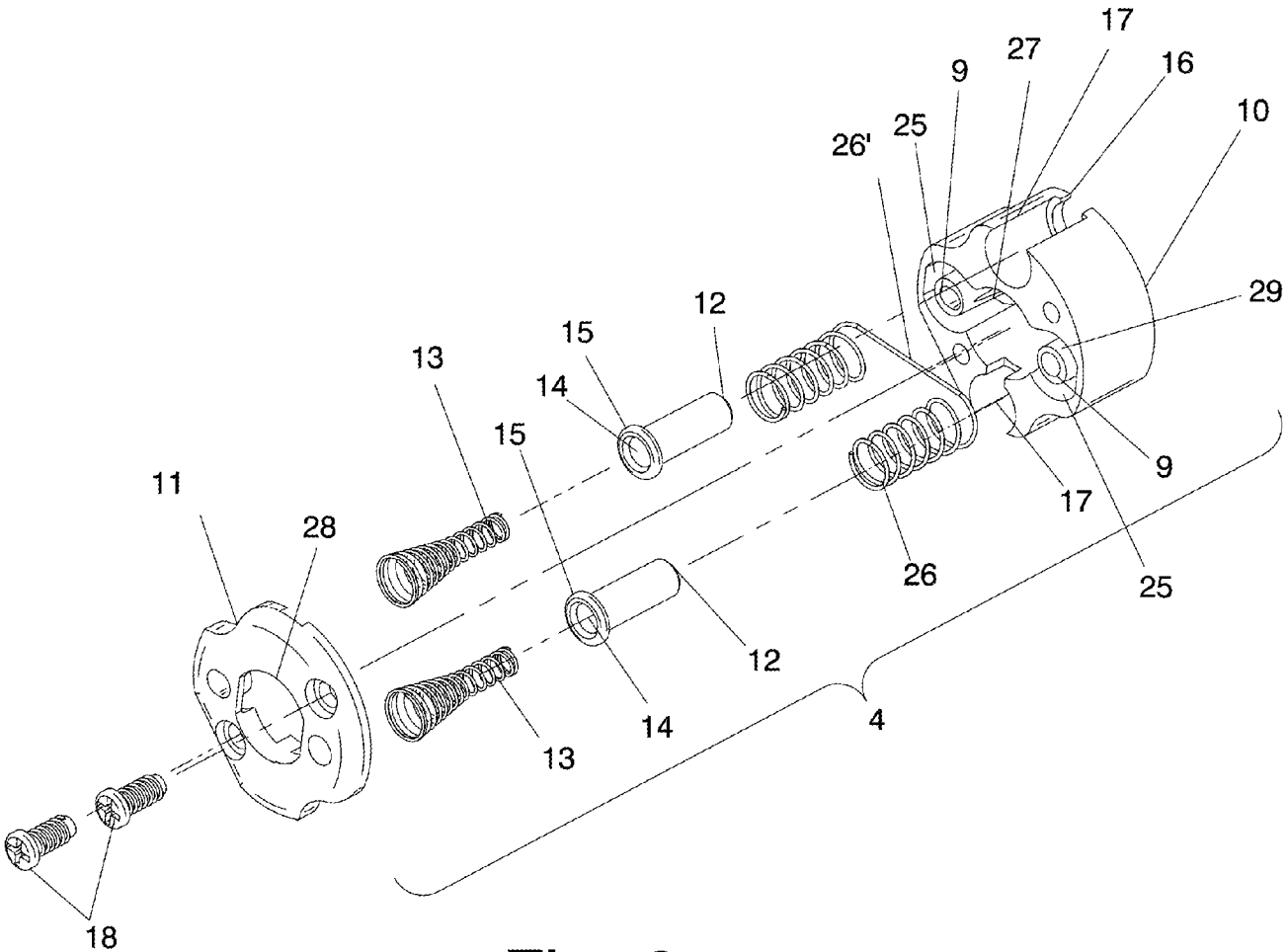

FIG. 2.—Shows an exploded perspective view of the improved clutch mechanism of the present invention.

Figure 3:
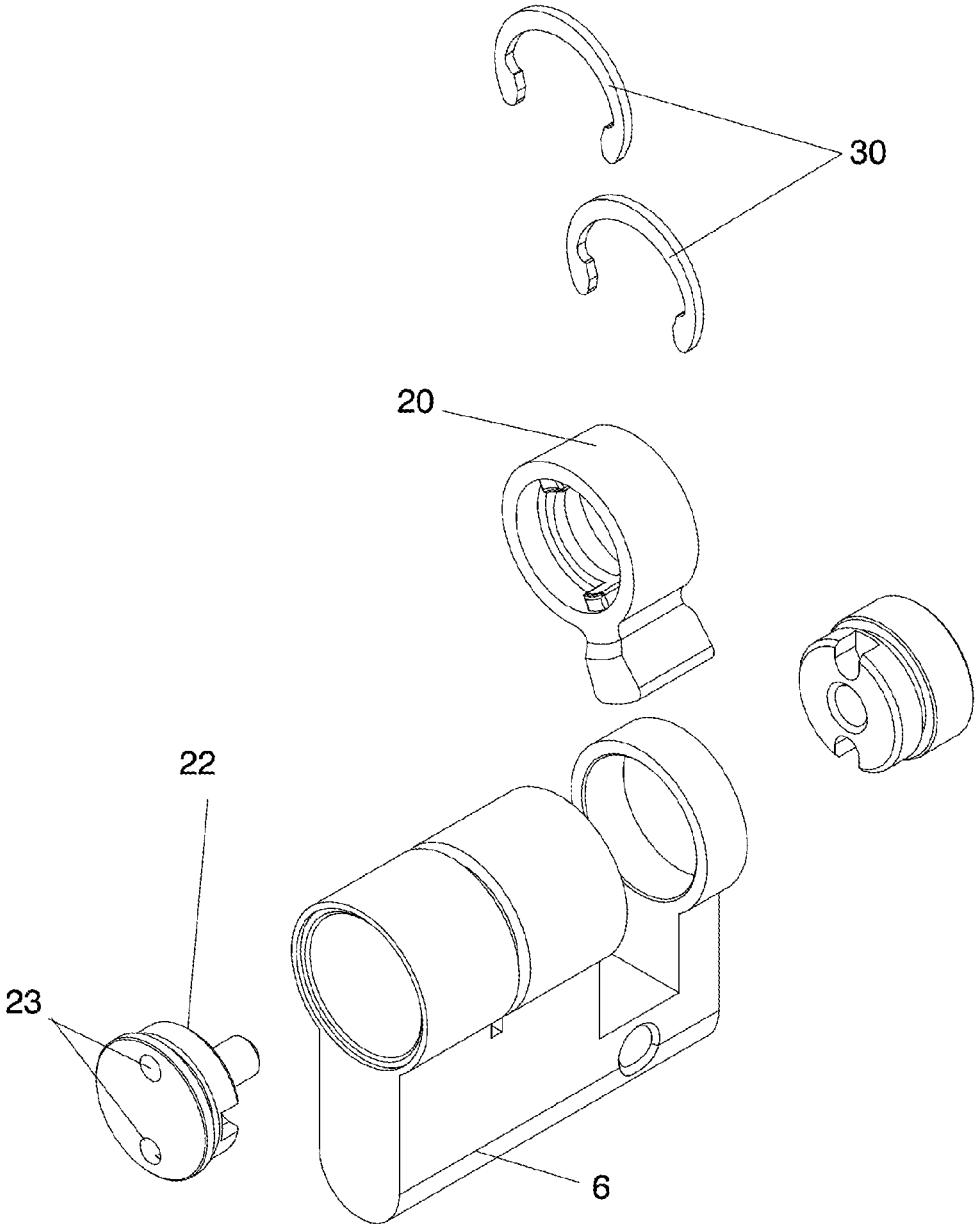

FIG. 3.—Shows an exploded perspective view of part of the clutch mechanism and the lock cylinder of the present invention.

Figure 4A:
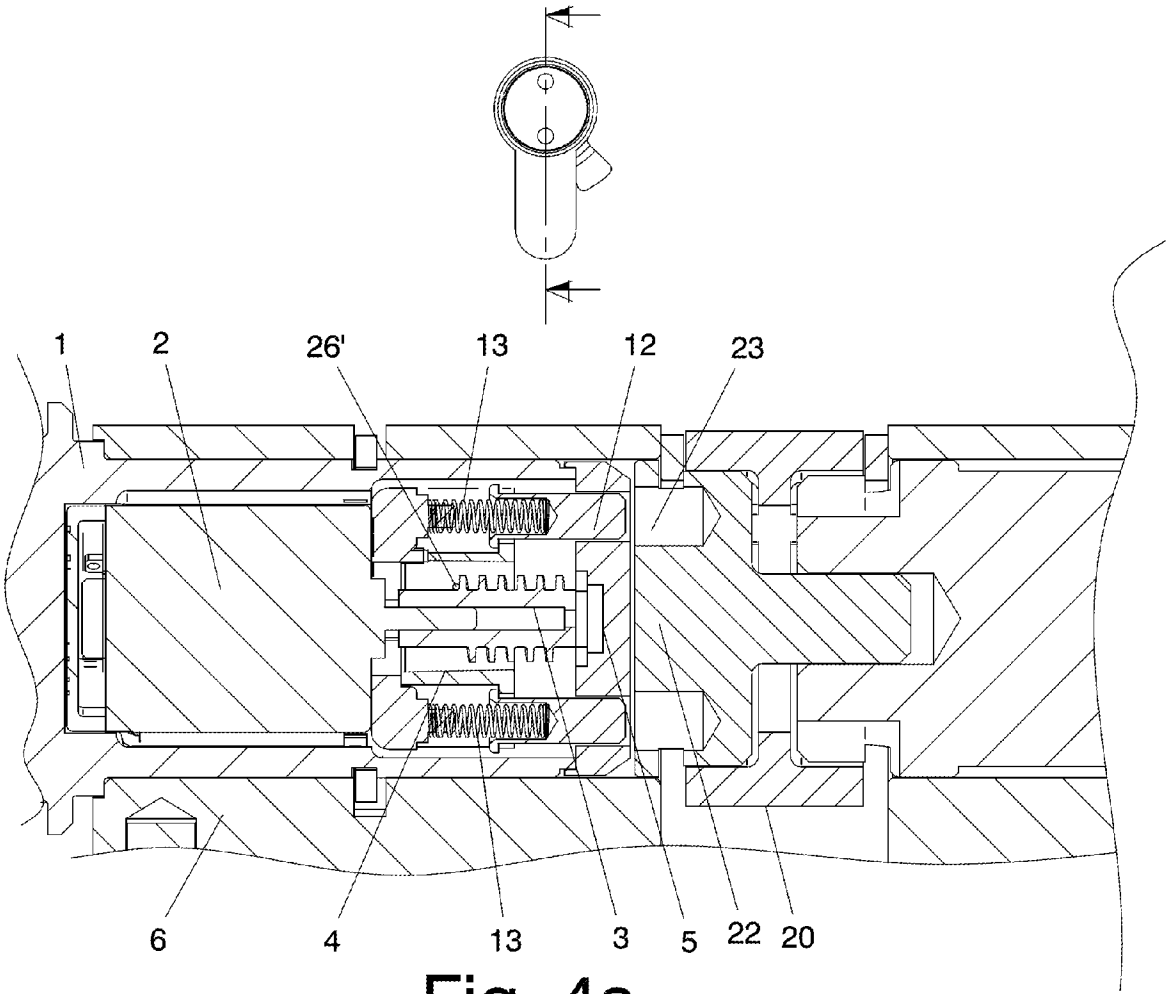

FIG. 4*a*.—Shows a sectional view of the clutch mechanism in the inactive (disengaged) position of the present invention.

Figure 4B:
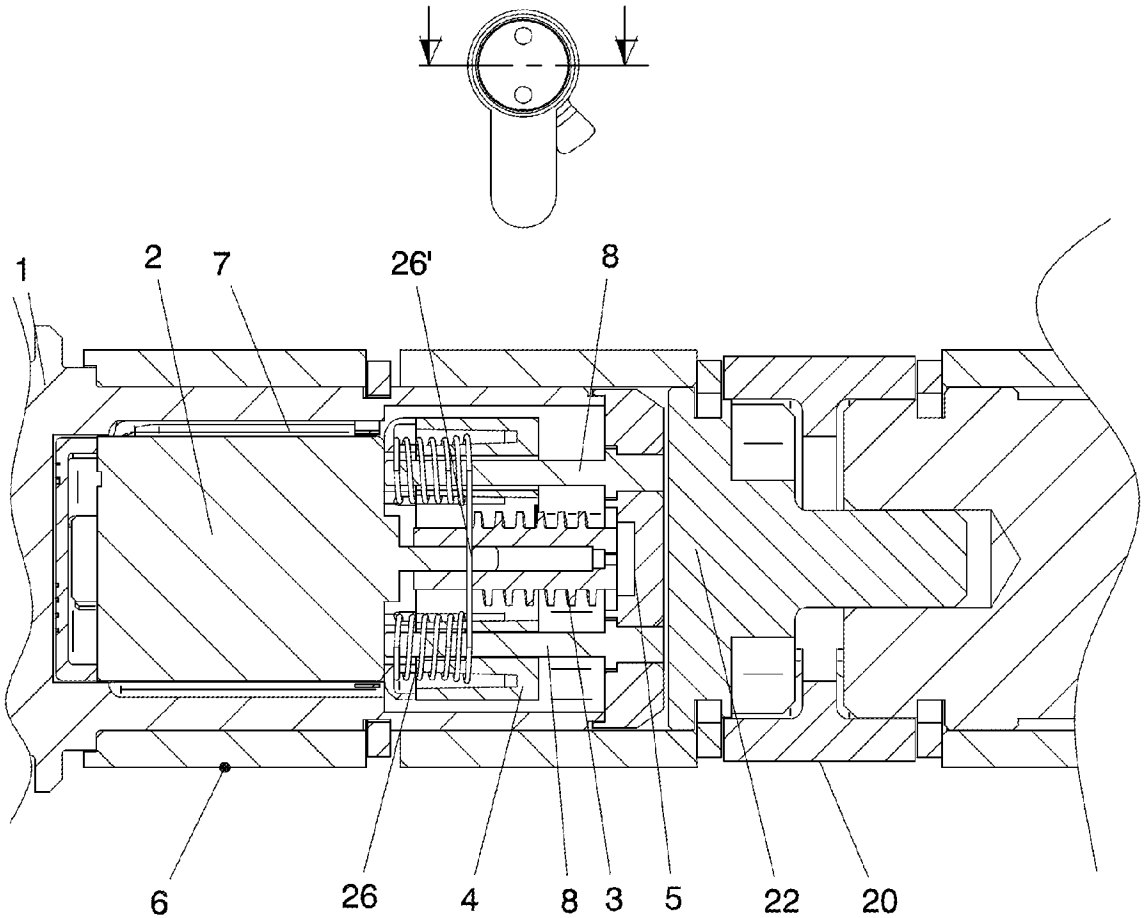

FIG. 4*b*.—Shows another sectional view of the clutch mechanism in the inactive position of the present invention.

Figure 5A:
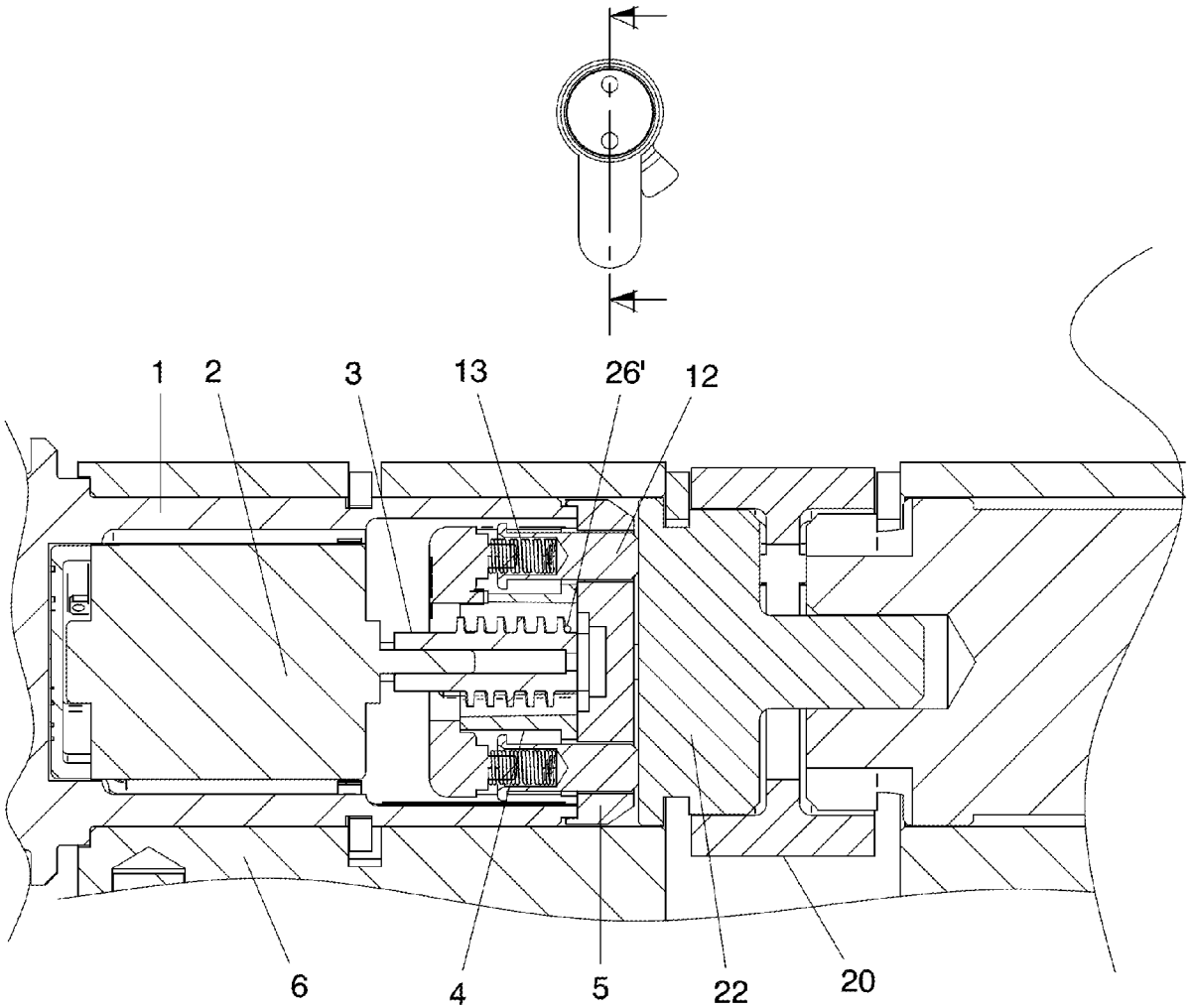
Figure 5B:
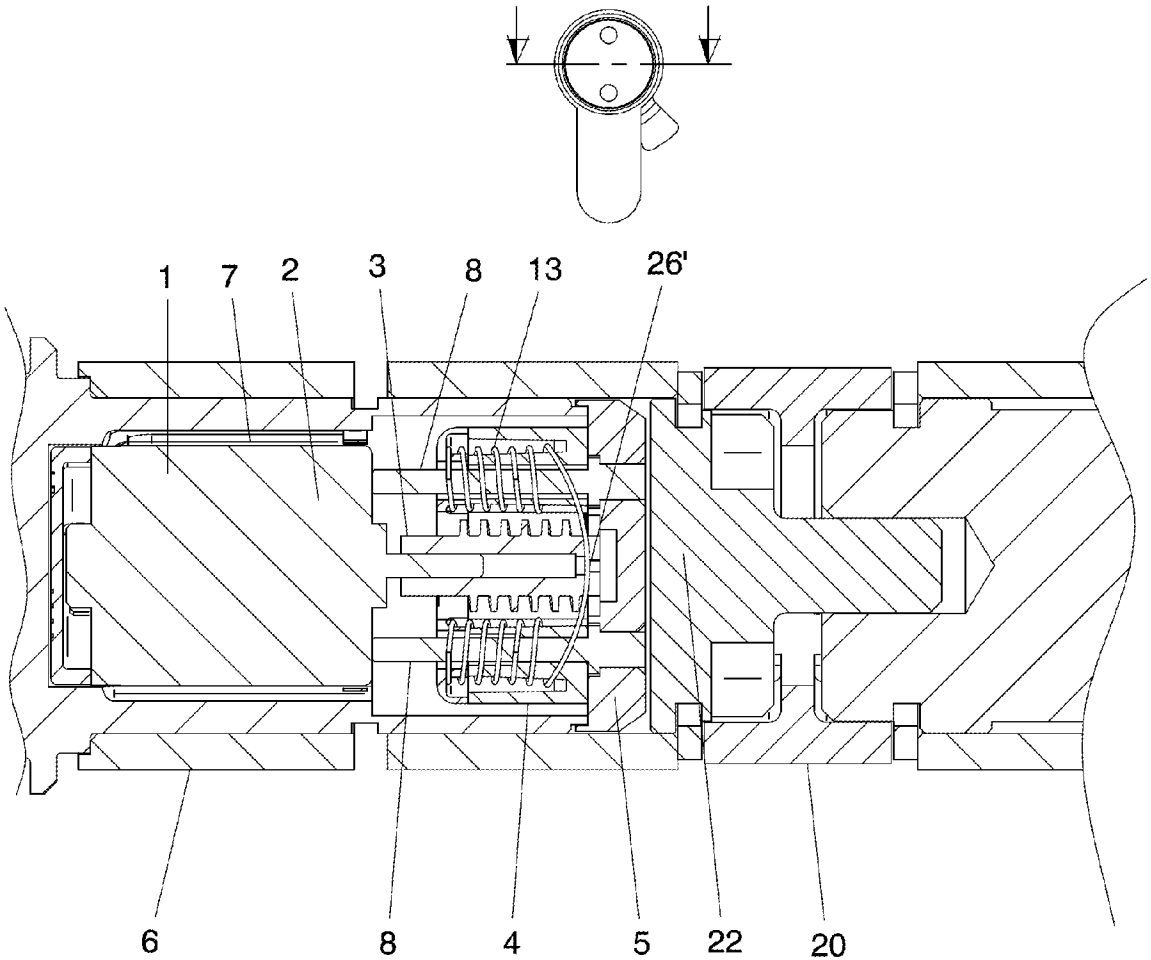

FIGS. 5*a*, 5*b*.—Show respective sectional views of the clutch mechanism of the present invention in the operating position, when there is an angular offset between the clutch pins included in the characteristic movable cart and holes of a clutch disc.

Figure 6A:
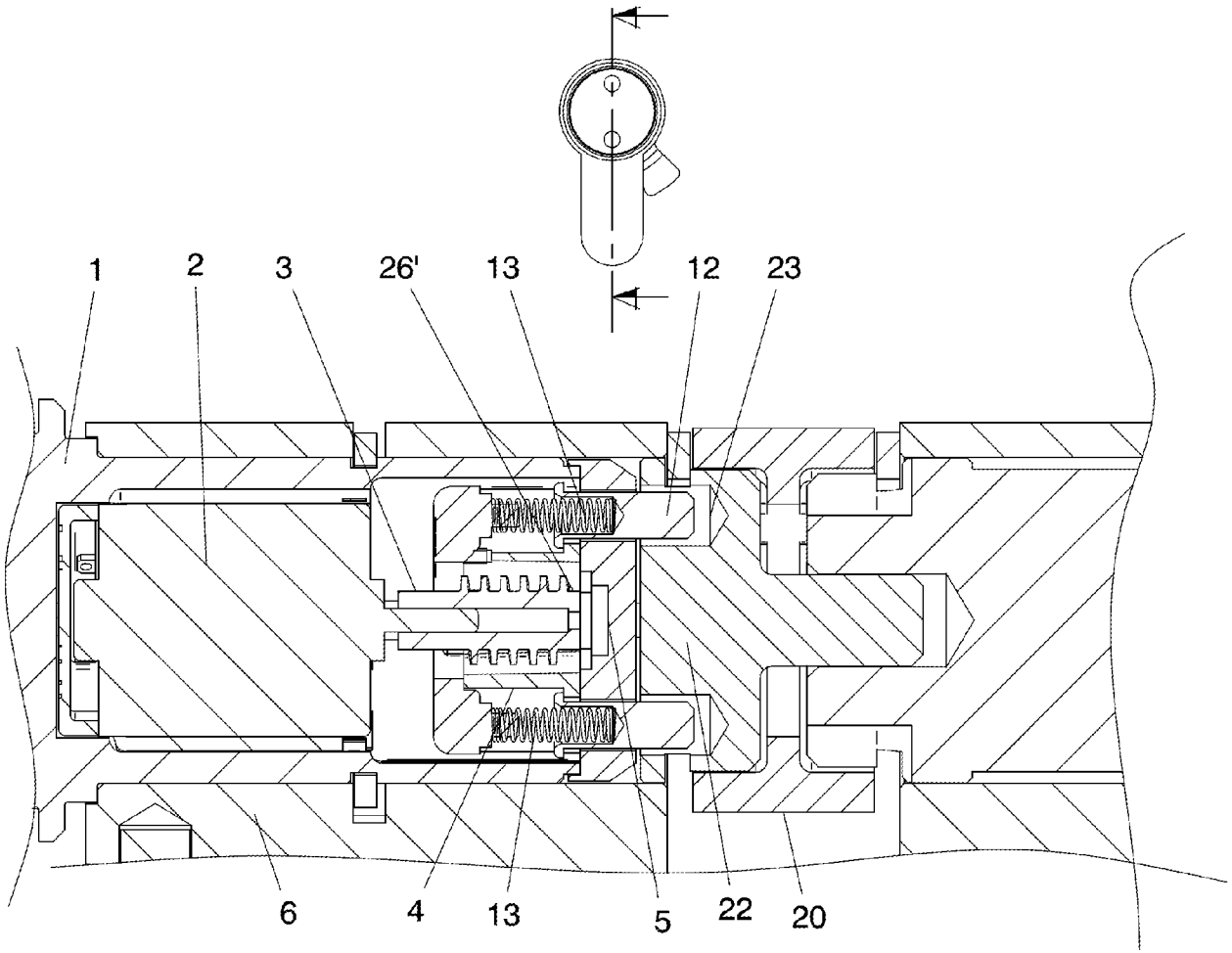
Figure 6B:
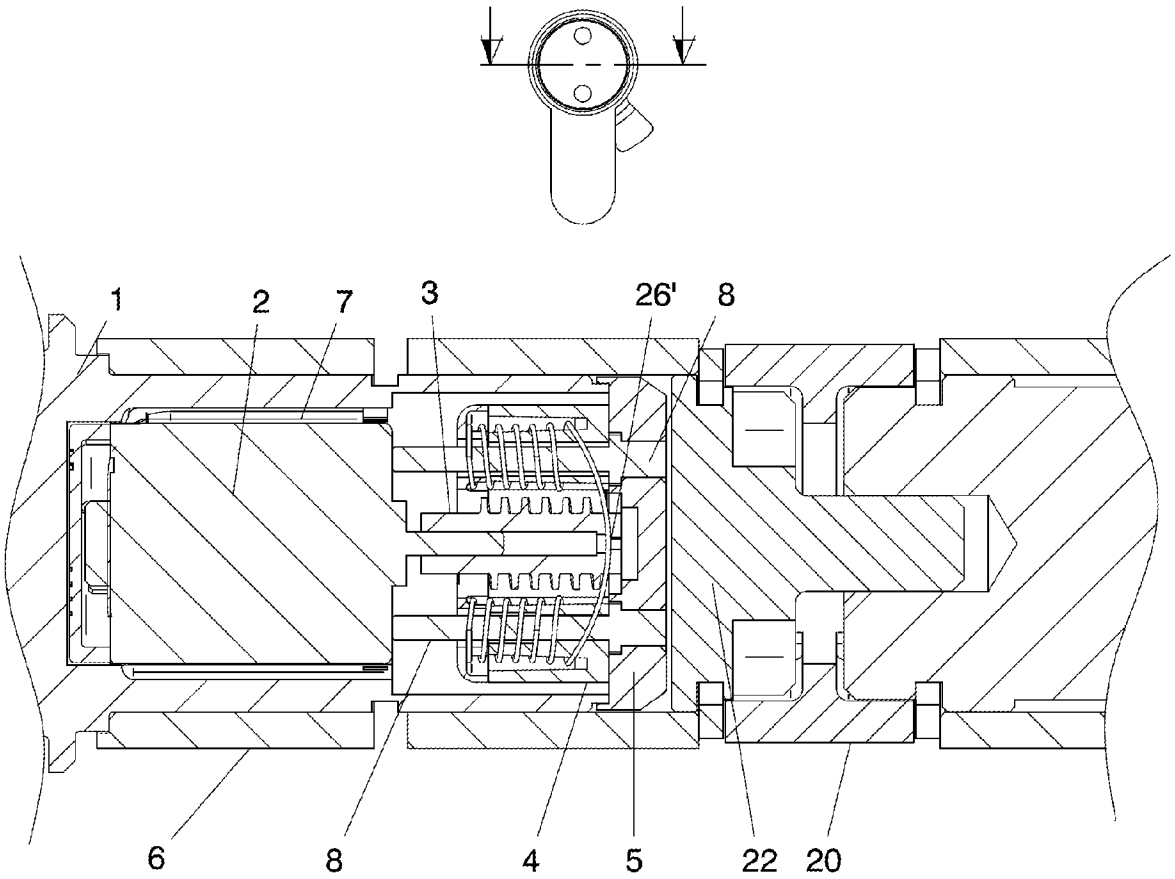
Figure 6C:
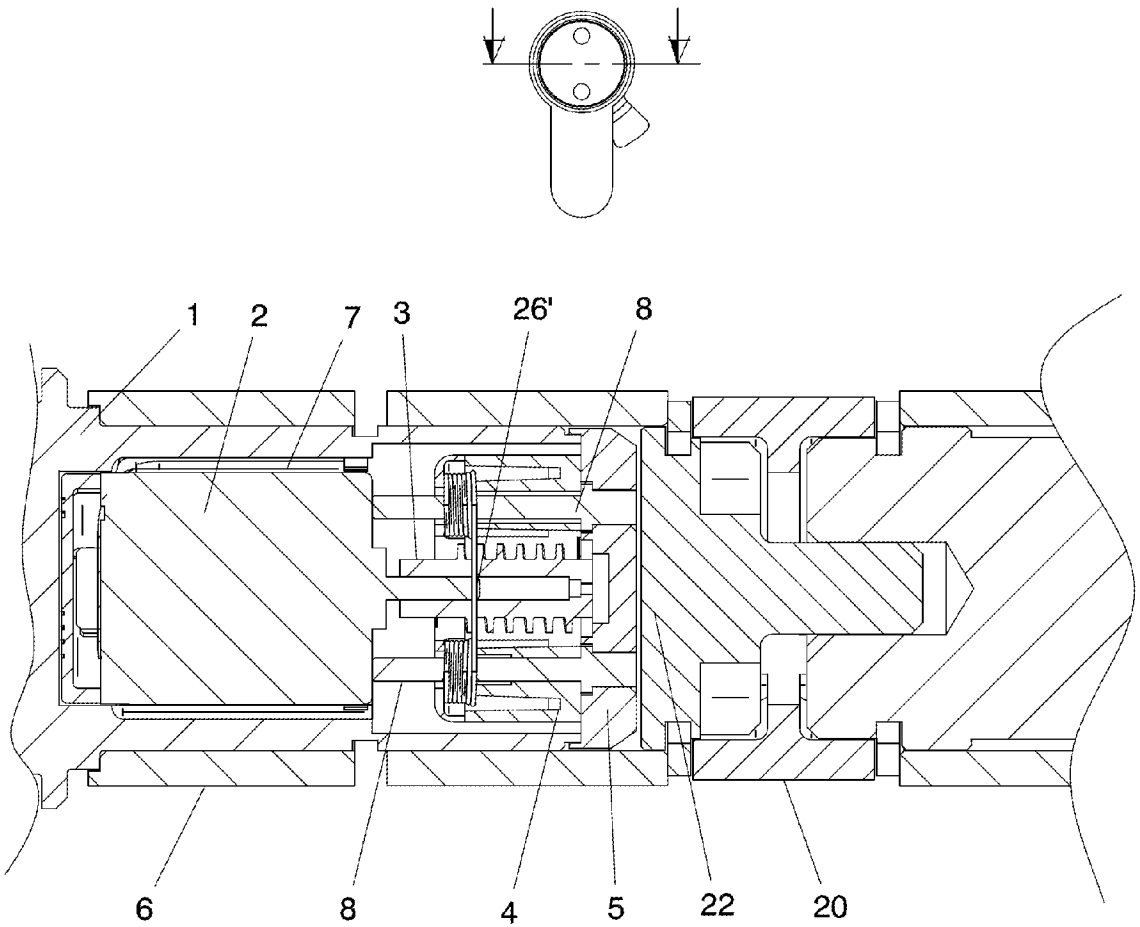

FIGS. 6*a*, 6*b* and 6*c*.—Show respective sectional views of the clutch mechanism in the active position of the clutch mechanism of the present invention.

DESCRIPTION OF AN EMBODIMENT OF THE INVENTION

Considering the numbering adopted in the figures, the improved clutch mechanism for electromechanical lock cylinders of the present invention, contemplates the following nomenclature used in the description:

1.—Rotor
2.—Electromagnetic Motor
3.—Spindle
4.—Movable cart
5.—Front lid
6.—Outer cylinder
7.—Control circuit
8.—Guides
9.—Through bores
10.—Base
11.—Lid
12.—Clutch pins
13.—Rear springs
14.—Axial housings
15.—End protrusions
16.—Inner protrusions
17.—Axial holes
18.—Screws
19.—Holes
20.—Cam
21.—Screws
22.—Clutch disc
23.—Axial holes
24.—Screws
25.—Side recesses
26.—Front springs
26'.—Common transverse portion
27.—Front through hole
28.—Rear through hole
29.—Tubular portions
30.—Resilient washers.

The clutch mechanism comprises a movable cart 4 displaceable by a spindle 3 driven by the rotation of the output shaft of an electromagnetic motor 2. The movable cart 4 is comprised by two opposing sides and joined together: a base 10 and lid 11, and between them, a pair of clutch pins 12 associated to respective rear springs 13, which are disposed between the lid 11 of the movable cart 4 and axial housings 14 provided in the rear end section of the clutch pins 12. These are housed and guided in its movement within axial holes 17 of the base 10 belonging to the movable cart 4, while the clutch pins 12 are retained in their foremost position in inner protrusions 16 located at the end of the axial holes 17 in combination with end protrusions 15 of the clutch pins 12 abutting against the inner protrusions 16.

In turn, both the base 10 and lid 11 of the movable cart 4, have two holes facing each other and respectively centered: a front through hole 27 and another rear through hole 28, the spindle 3 being located in both, rotation of which causes the forward and backward movements the movable cart assembly 4.

The base 10 and lid 11 are integral with each other by using screws 18.

Furthermore, in diametrically opposite areas, the inner face of the base 10 flanking its front through hole 27, includes two side recesses 25, wherein are in turn housed frustoconical tubular portions 29, to which is coupled a resilient device consisting of two springs 26 joined together by one of their ends through a common transverse portion 26' forming part of both front springs 26 with helical structure, all this constituting a single integral piece making up the above mentioned resilient device.

The common transverse portion 26' of the resilient device perpendicularly crosses the front through hole 27 of the base 10 of the movable cart 4, while coupled in the valley of the threading of the spindle 3, thus, the rotation of the latter will drag the movable cart 4 in either direction depending on the sense of rotation of such spindle 3 via the common transverse portion 26' of the resilient device.

Moreover, the tubular portions 29 of base 10 to which are coupled both front springs 26 include through bores 9 through which the guides 8 of a front lid 5 of a rotor 1 housing therein the electromagnetic motor 2 and also the movable cart 4 are inserted, the rotor 1 being in turn housed within an outer lock cylinder 6.

The axial displacement of the movable cart 4 is guided and driven into the guides 8 of the front lid 5 for emerging or establishing the withdrawal of the clutch pins 12. The clutch pins, in the open position, emerge through holes 19 located in the front lid 5 of the rotor 1, the clutch pins 12 being in turn latched in axial holes 23 of a clutch disc 22 disposed next to the front lid 5. In this situation, the clutch mechanism is arranged so that by actuating an external knob, not shown in the figures, carries out the opening of the door by being able to move a cam 20 dragging in its rotary motion the clutch disc 22, the latter being fixed to the cam 20 by come screws 21, by means of resilient washers 30 or by using other conventional devices.

It should be noted that the diametrical direction where the tubular portions 29 are located, is perpendicular to the diametrical direction wherein the holes 1 of the base 10 forming part of the movable cart 4 are located.

The electromagnetic motor 2 has a control circuit 7, which in addition to control the operation of the motor also performs the functions of detecting the corresponding end strokes, such as described in the patent of the state of the art.

The rotor 1 is a hollow body with cylindrical configuration, inside of which the actuation electromagnetic motor 2 is mounted, in output shaft of which the spindle 3 is axially mounted, the latter being provided so as producing in its rotation a linear displacement of the movable cart 4 located inside the rotor 1, such as already mentioned above, this being closed at its free end by the lid 5, so that the referred assembly, i.e., the rotor 1 with the other elements corresponding to the clutch mechanism, are within the outer lock cylinder 6.

The front lid 5, into guide 8 of which is driven the movable cart assembly 4, is fixed to the rotor 1 by using screws 24.

The element that provides the motion to the improved movable cart 4 is the common transverse portion 26'. In this case and by not being the common transverse portion 26' doubly latched as with the "U"-shaped resilient member of the patent from the state of the art, the common transverse portion 26' has a greater deformation with the advantages that this entails and which are indicated below.

In FIGS. 4 to 6 the different positions of the clutch mechanism with the improved movable cart 4 can be appreciated, in the disengaged position (FIGS. 4*a* and 4*b*), in operating position when there is the angular offset between the clutch pins 12 and axial holes 23 of the clutch disc 22 (FIGS. 5*a* and 5*b*) and finally, in the engaged position, as depicted in FIGS. 6*a* and 6*b*.

In FIG. 4*b* and FIG. 6*b* can be seen the movable cart 4 in the end stroke positions, disengaged in FIG. 4*b*, so that in this position the front springs 26 are in a medium compression state, therefore, the common transverse portion 26' is continuously suffering a thrust towards the fillet of the spindle 3 thread, which makes that at the time when the spindle 3 is set to rotate, to immediately move the common transverse portion 26', ensuring the operation of the system.

Similarly, in the engaged position (FIG. 6*b*), the common transverse portion 26' is deformed (situation of over-elongation) due to the absence of the double latching as in the patent from the state of the art, so that said deformation causes the common transverse portion 26' being in permanent contact with the fillet of the spindle 3 thread, which causes as in the previous case, that at the time in that the spindle 3 starts its rotation, to immediately move the common transverse portion 26', ensuring the operation of the system.

Also the design specifications of the cart, for ensuring the contact between the resilient member and the spindle, are not as restrictive as in the invention of the patent from the state of the art.

Moreover, the power load of the resilient member of the present invention is greater than that of the resilient member of the invention of the patent from the state of the art. This is because the wire length of the resilient member of the present invention is the length of the transverse portion 26' plus that of the springs 26 and, therefore, is greater than the length of the major branch of the "U"-shaped resilient member of the patent from the state of the art.

On the other hand, if were the case in that the user is applying a torque to the knob against the lock mechanisms, i.e. the clutch pins 12 are left disposed (blocked) between the front lid 5 of the rotor 1 and the clutch disc 22 not being able to be removed, then the movable cart 4 cannot move.

However, unlike the cart of the state of the art, the movable cart 4 of the present invention, when the spindle 3 rotates, the common transverse portion 26' cannot move the cart, since it is trapped by the clutch pins 12, so that the energy used in compressing the front springs 26, such that once the clutch pins 12 are released, the movable cart 4 is also released and the front springs 26 are decompressed displacing the movable cart 4 to the disengaged position.

At the time of compressing the springs 26, the power consumption is greater than that existing when the cart is moved in a normal operating mode, whereby the control circuit of the motor detects the latching of the pins. By that time, the control circuit continues rotating the spindle and, therefore, moving the common transverse portion 26' to a position such that, when releasing the clutch pins, these are in the disengaged position. Subsequently and after a long period of time, the control circuit provides a single command to the motor for moving back the cart to the end stroke disengaged position and not repeated as in the main patent.

Therefore, by using the improved movable cart 4 of the present invention, there is also avoided an increase of the energy consumption of the electromagnetic motor 2, and thus lengthens the life of the battery feeding it.

Finally, it should be noted that due to the new structure and configuration of the movable cart 4, the assembly of the elements is much faster and easier.

The invention claimed is:

1. A clutch mechanism for an electromechanical lock cylinder, comprising:

an electromagnetic motor (2) having an output shaft connected to a threaded spindle (3);

a movable cart (4) axially displaceable by said spindle (3), the movable cart (4) in turn comprising clutch pins (12);

a resilient device disposed in an interior of said movable cart (4), said resilient device being constituted by two front springs (26) joined together at one of their ends by a common transverse portion (26') engaged in a valley of the spindle (3) thread, said resilient device being configured to move the movable cart (4) via said common transverse portion (26') between a disengaged position and an engaged position, such that in the disengaged position, the front springs (26) are compressed and in the engaged position said common transverse portion (26') is deformed, such that in both positions said common transverse portion (26') carries out a continuous thrust on the spindle (3);

wherein said front springs (26) are constituted by compressions springs; and wherein said compressions springs (26) are constituted by coil springs.

2. The clutch mechanism according to claim 1, further comprising a control circuit of the electromagnetic motor (2) which, in case of blocking the movable cart (4) in the engaged position by the action of a user, said control circuit detects the latching of the clutch pins (12) and continues compressing the front springs (26) by the action of the spindle (3) on the common transverse portion (26') up to a such a position that when the blocking action by the user is finished, the clutch pins (12) are released and the movable cart (4) is moved up to the disengaged position by decompressing the front springs (26).

3. The clutch mechanism according to claim 2, wherein the control circuit detects the latching of the clutch pins (12) by detecting an excess of an energy consumption in the compression of the front springs (26) carried out by the action of the spindle (3) on the common transverse portion (26') when trying to carry the movable cart (4) from the engaged position to the disengaged position.

4. The clutch mechanism according to claim 3, wherein said front springs (26) are coupled in tubular portions (29) departing from the bottom of side recesses (25) of a base (10) comprised in the movable cart (4), said side recesses (25) being located at diametrically opposite points of the inner face of the base (10) of the movable cart (4).

5. The clutch mechanism according to claim 3, further comprising guides (8) guiding the movable cart (4) in its axial movement, said guides (8) forming part of a front lid (5); said guides (8) are coupled and guided into through bores (9) established in the tubular portions (29).

6. The clutch mechanism according to claim 2, wherein said front springs (26) are coupled in tubular portions (29) departing from the bottom of side recesses (25) of a base (10) comprised in the movable cart (4), said side recesses (25) being located at diametrically opposite points of the inner face of the base (10) of the movable cart (4).

7. The clutch mechanism according to claim 2, further comprising guides (8) guiding the movable cart (4) in its axial movement, said guides (8) forming part of a front lid (5); said guides (8) are coupled and guided into through bores (9) established in the tubular portions (29).

8. The clutch mechanism according to claim 1, wherein said front springs (26) are coupled in tubular portions (29) departing from the bottom of side recesses (25) of a base (10) comprised in the movable cart (4), said side recesses (25) being located at diametrically opposite points of the inner face of the base (10) of the movable cart (4).

9. The clutch mechanism according to claim 8, further comprising axial holes (17) in the base (10) wherein the clutch pins (12) are housed, which are arranged in a diametrical direction and perpendicular to the diametrical direction in which the tubular portions (29) are located.

10. The clutch mechanism according to claim 8, further comprising guides (8) guiding the movable cart (4) in its axial movement, said guides (8) forming part of a front lid (5); said guides (8) are coupled and guided into through bores (9) established in the tubular portions (29).

11. The clutch mechanism according to claim 1, further comprising guides (8) guiding the movable cart (4) in its axial movement, said guides (8) forming part of a front lid (5); said guides (8) are coupled and guided into through bores (9) established in the tubular portions (29).

12. The clutch mechanism according to claim 11, further comprising axial holes (17) in a base (10) wherein the clutch pins (12) are housed, which are arranged in a diametrical direction and perpendicular to the diametrical direction in which the tubular portions (29) are located.

13. The clutch mechanism according to claim 1, wherein said coil springs (26) are elongated in a direction generally parallel with said spindle (3), and said common transverse portion (26') extends between said coil springs (26) in a direction generally transverse to said spindle (3).

14. The clutch mechanism according to claim 13, wherein said movable cart (4) comprises a base (10) having recesses (25) therein and tubular portions (29) projecting in said recesses (25) from a bottom of said recesses (25); and said coil springs (26) are respectively mounted about said tubular portions (29).

* * * * *